US005907279A

United States Patent [19]

Bruins et al.

[11] Patent Number: 5,907,279

[45] Date of Patent: May 25, 1999

[54] INITIALIZATION OF A WIRELESS SECURITY SYSTEM

[75] Inventors: Johannes D. Bruins, Eindhoven, Netherlands; Mario R. Nicora, Varese, Italy

[73] Assignee: U.S. Philips Corporation, New York, N.Y.

[21] Appl. No.: 08/799,615

[22] Filed: Feb. 10, 1997

[30] Foreign Application Priority Data

Feb. 8, 1996 [EP] European Pat. Off. ..... 96200275

[51] Int. Cl.[6] ..... G08B 29/00

[52] U.S. Cl. ..... 340/506; 340/539; 340/825.69

[58] Field of Search ..... 340/506, 539, 340/825.69, 825.72

[56] References Cited

U.S. PATENT DOCUMENTS

| | | | |
|---|---|---|---|
| 4,855,713 | 8/1989 | Brunius et al. | 340/506 |
| 4,951,029 | 8/1990 | Severson | 340/506 |
| 5,278,547 | 1/1994 | Suman et al. | 340/825.31 |

OTHER PUBLICATIONS

Home Security System, 1995, Grundig, pp. D1–D41.

*Primary Examiner*—Donnie L. Crosland
*Attorney, Agent, or Firm*—Steven S. Rubin

[57] ABSTRACT

In a security system, detector apparatuses (101, 102, 103) transmit an alarm message to a central apparatus 100 via RF in response to detecting an alarm condition. The message comprises a source identification uniquely identifying the transmitting apparatus. The central apparatus 100 raises an alarm if the alarm message is sent by a detector apparatus, which is part of the system. To this end, the central apparatus 100 only processes an alarm message if the source identification of the alarm message is stored in a memory means 200 of the central apparatus. For a new detector apparatus to be accepted as part of the system, the identification of the detector apparatus needs to be stored in the memory means 200 of the central apparatus. To reduce the chance of identifications of neighboring apparatuses inadvertently being stored, a detector apparatus transmits a learn-detector message in response to a learn trigger, for instance from a user. The central apparatus 100 stores the source identification of a received learn-detector message only if the central apparatus 100 is in a learning mode.

17 Claims, 4 Drawing Sheets

INITIALIZATION OF A WIRELESS SECURITY SYSTEM

BACKGROUND OF THE INVENTION

1. Field of the Invention

The invention relates to a security system, comprising a central apparatus and at least one detector apparatus; the detector apparatus comprising transmission means for wirelessly transmitting a message comprising a source identification uniquely identifying the transmitting apparatus, and detection means for detecting an alarm condition and in response causing the transmission means to transmit a message; the central apparatus comprising: memory means for storing a source identification of at least one detector apparatus; alarm means for raising an alarm; user interface means for bringing the central apparatus in a selected one of a plurality of modes, including an operational mode and a learning mode; and reception means for receiving a wirelessly transmitted message, for storing, in the learning mode, the source identification of a received message in the memory means, and for causing, in the operational mode, the alarm means to raise an alarm if the source identification of a received message is stored in the memory means.

The invention further relates to a central apparatus, a detector apparatus, a confirmation apparatus, and a remote control for use in such a security system.

2. Description of Related Art

Traditionally detector apparatuses, such as burglar detectors, transmit an alarm message to a central apparatus of the security system via a wired connection when the detector apparatus detects an alarm condition. When the central apparatus receives an alarm message it uses alarm means, such as a siren or a light, to raise an alarm. Also silent alarm may be raised, for instance by triggering a remote security company or the police. Such systems are typically installed and maintained by professional companies. Similar systems of reduced complexity are available for domestic use and can be installed and maintained by a technically skilled consumer. With the continuing drop in cost and power requirements of electronic components and the liberalisation of the use of certain RF transmission bands, cost-effective cord-less security system have become available which can be installed and maintained by the general public. Such a system is known from the Home Security System, 1995 of Grundig. Each detector apparatus is locally powered, for instance, by a battery. The detector apparatus transmits a message via RF to the central apparatus, upon detecting an alarm condition, making the system fully cordless. Unlike wired systems, the communication is, in principle, not restraint to the principal area to be protected by the system. Typically, the communication range is 30 meters, allowing the system to cover an area with a diameter of approximately 60 meters, with the central apparatus at the centre. In many domestic situations this implies that (parts of) neighbouring houses or apartments are included in this communication area, whereas, in general, the area to be protected is limited to a smaller area, such as one house or one apartment. To ensure that the central apparatus only responds to alarm messages transmitted by detectors, which are intended to be guarded and, for instance, not by detectors which are part of a neighbouring security system, a alarm message is only accepted if it is transmitted by a detector which is known to the central apparatus. Each apparatus has a unique communication address. Whenever a detector apparatus transmits an alarm message, the unique address is included in the alarm message as the source address of the message. Before an alarm message is accepted from a specific detector apparatus, the detector apparatus needs to be trained to the central apparatus. During the training, first the central apparatus is brought into a learning mode, by using a key to bring the central apparatus into the installation mode and pressing a button on the central apparatus to bring the central apparatus to a learning mode. Next, an alarm is triggered on the detector apparatus, which needs to be learned. Typically, a tamper alarm is triggered. Upon receiving the resulting alarm message, the central apparatus stores the source address of the received alarm message in a memory. The user can select the memory location in which a specific detector is stored. Using buttons on the central apparatus, the user can selectively disable or enable memory locations. Alarm messages from a detector apparatus, whose memory location has been disabled, are not acted upon by the central apparatus. In this ways, zones of a house, each covered by a detector apparatus, can selectively be guarded or not guarded. It is desired that the chance is reduced of an apparatus being trained, which should not be part of the system. In order to avoid that a neighbouring detector apparatus, which transmits an alarm message at the moment of the central apparatus being in the learning mode, is stored in the central apparatus, the Home Security System of Grundig requires a detector apparatus to be near the central apparatus for the detector apparatus to be accepted. Since the normal operational distance is larger, this requires the central apparatus to use different thresholds for receiving messages. Furthermore, limiting the operational distance provides no adequate protection in certain situations of, for instance terraced houses or apartments, where typically entrances are located immediately next to one another and central apparatuses and some detector apparatuses tend to be located in the entrance halls. Moreover, this requires detector apparatuses to be near the central apparatus and not at the location/zone where the detector apparatus is intended to operate. This increases the chance of the user, mistakenly, placing a detector apparatus in a different zone than programmed on the central apparatus. Since the alarm raised by the central apparatus, in the Grundig system, is specific for a memory location (and therefore for a zone), this may have a significant impact.

Among others, it is an object of the invention to provide a wireless security system with an improved routine for learning detector apparatuses. More specifically, it is an object to reduce the chance of a detector apparatus unwantedly being programmed into the central apparatus. A further object of the invention is to provide a wireless security system in which the detector apparatus can be programmed into the central apparatus from any location within the normal operating range of the system.

OBJECTS AND SUMMARY OF THE INVENTION

The system according to the invention is characterised in that the detection means is adapted to cause the transmission means to transmit an alarm message in response to detecting an alarm condition; in that the detector apparatus comprises means for causing the transmission means to transmit a learn-detector message in response to a learn trigger; said learn-detector message being distinct from said alarm message; in that the reception means is adapted to cause the alarm to be raised in response to receiving an alarm message, and to store the source identification only of a received learn-detector message.

By using a special learn-detector message, which differs from an alarm message, the detection of an alarm condition by a neighbouring detector apparatus can not lead to the neighbouring detector unwantedly being programmed. This makes the system more secure. It also makes it possible to use one threshold for receiving messages, making the system simpler. By further ensuring that the detector apparatus only transmits the learn-detector in response to a specific learn trigger, for instance from a user and not in response to detecting an alarm condition, the chance of a learn-detector message being transmitted, while the central apparatus is in the learning mode, is very low.

An embodiment according to the invention is characterised in that the user input means of the detector apparatus is conceived to bring the detector apparatus in a selected one of a plurality of modes, including an operational mode and a learning mode; in that the detection means is conceived to only cause the transmission means to select and transmit the alarm message if the detector apparatus is in the operational mode; and in that the user input means of the detector apparatus is conceived to only cause the transmission means to select and transmit a learn-detector message if the detector apparatus is in the learning mode. By only responding to a user trigger to send a learn-detector message when the detector apparatus is in the learning mode a further barrier against unwanted programming is built into the system. It is also possible to use further barriers against bringing a detector apparatus into the learning mode, such as requiring the use of a key or access to a mode switch which is difficult to access.

A further embodiment according to the invention wherein the system comprises a plurality of different types of detector apparatuses; each type of detector apparatus detecting a different type of alarm condition external to the detector apparatus, is characterised in that the learn-detector message comprises type information identifying the type of detector apparatus; and in that the alarm means is conceived to raise a type-specific alarm. In the Grundig system a specific alarm can be raised depending on the memory location in which the source identification of the transmitting detector apparatus has been stored. Four memory locations are allocated to burglar detectors and four memory locations are allocated to other transmitters including technology detectors, such as smoke/fire and gas detectors, and remote controls. Whereas for the first category of apparatuses the alarm is only raised when the system is armed, for the second category the alarm is also raised when the system is disarmed. The user may, however, inadvertently program an apparatus in a memory location of the wrong category. In the system according to the invention this is not possible, since the detector apparatus provides the type information itself. When the central apparatus receives an alarm message, the detector type information obtained during training is used to raise a type-specific alarm, instead of a memory location specific alarm. Whereas in the Grundig system no more than four burglar detectors can be used, even if not all memory locations of the other four locations are used (otherwise a wrong alarm would be raised), in the system according to the invention identifications are not pre-allocated to specific types of detector apparatuses, providing more flexibility.

A further embodiment according to the invention is characterised in that the source identification corresponds to one of a plurality of groups of source identifications; each group corresponding to one of the different types of detector apparatuses and in that the alarm means derives the type information from the source identification of a received alarm message. By using the identification for identifying the type of detector apparatus no additional storage or operations are required in the central apparatus.

An alternative embodiment according to the invention is characterised in that the alarm and learn-detector message comprise a first field comprising the source identification and a second field comprising the type information; and in that the reception means is conceived to also store, in the learning mode, the type information of a received learn-detector message. By using a separate field for the type information, full flexibility in assigning identifications is maintained.

A further embodiment according to the invention wherein the system comprises a plurality of different types of detector apparatuses; each type of detector apparatus detecting a different type of alarm condition external to the detector apparatus, is characterised in that the detection means is conceived to cause the transmission means to select and transmit a type-specific alarm message; and in that the alarm means is conceived to raise a type-specific alarm. The use of type-specific alarm messages, makes it possible to raise an alarm which is optimised for the detected alarm condition.

A further embodiment according to the invention is characterised in that the detector apparatus comprises a plurality of different types of detection means for detecting different types of alarms conditions external to the detector apparatus; in that the detection means is conceived to cause the transmission means to select and transmit a type-specific alarm message in response to detecting an alarm condition; and in that the alarm means is conceived to raise a type-specific alarm. In order to be able to raise a type-specific alarm for a number of detectors, such as a smoke and gas detector, combined into one detector apparatus the identification of the detector apparatus needs to be stored only once, requiring only one memory location in the central apparatus.

A further embodiment according to the invention is characterised in that the system comprises a confirmation apparatus; in that the central apparatus comprises transmission means for selecting one of a plurality of distinct messages, said plurality including a status message indicating a status of the system and a learn-central-apparatus message; the message comprising a source identification uniquely identifying the central apparatus; and for transmitting the selected message via RF; in that the user interface means of the central apparatus is conceived to cause the transmission means to select and transmit the learn-central-apparatus message in response to a user trigger; in that the confirmation apparatus comprises user interface means for bringing the confirmation apparatus in a selected one of a plurality of modes, including an operational mode and a learning mode in response to user input; in that the confirmation apparatus comprises reception means for receiving a message transmitted via RF, for storing the source identification of a received learn-central-apparatus message in a memory only if the confirmation apparatus is in the learning mode, and for causing the user interface means to indicate the status of the system in response to receiving a status message whose source identification is stored in the memory.

In this way, the confirmation display can indicate the status of the system and is not hindered by neighbouring systems. Advantageously, the confirmation apparatus only needs to store one identification and needs not to be aware of the detector apparatuses present in the system. The steps required for learning the identification of the central apparatus ensure that the chance of learning the identification of a neighbouring central apparatus is reduced.

A further embodiment according to the invention is characterised in that the user interface means of the central apparatus is conceived to only cause the transmission means to select and transmit the learn-central-apparatus message if the central apparatus is in the learning mode. By only transmitting the learn-central-apparatus message when the central apparatus is in the learning mode further increases the reliability of the learning.

A further embodiment according to the invention, wherein the system comprises a remote control; the remote control comprising transmission means for wirelessly transmitting a message comprising a source identification uniquely identifying the transmitting remote control, and user input means for causing the transmission means to transmit in response to a user trigger a trigger-specific user-input message to the central apparatus, is characterised: in that the memory means comprise a plurality of memory locations for storing source identifications of remote controls; in that the user interface means of the central apparatus is conceived to, in response to a user trigger, remove all source identifications of remote controls from the memory; in that the user input means of the remote control is conceived to cause the transmission means to transmit a learn-remote message in response to a learn trigger from a user; in that the reception means of the central apparatus is conceived to store the source identification of a received learn-remote message if the memory comprises no source identification of a remote control yet; and in that the reception means of the central apparatus is conceived to relay a received user-input message to the user interface means for further processing if the source identification of the message is stored in the memory.

The central apparatus only accepts user control input from a remote control whose identification has been stored. If no remote control has been learned yet, the step-wise learning process ensures that the chance of inadvertently learning the identification of a wrong remote control is reduced. Preferably, triggering the clearing of an identification of a remote control from the memory can only occur under secure conditions, for instance by using a key or a 'hidden' button of the central apparatus. Advantageously, the central apparatus comes pre-programmed for at least one remote control, which is supplied together with the central apparatus, reducing the need to program a first remote control.

A further embodiment according to the invention is characterised in that the reception means of the central apparatus is conceived to bring the central apparatus into a learn-remote mode in response to receiving a first learn-remote message if the source identification of the first learn-remote message is stored in the memory, and in that the reception means of the central apparatus is conceived to store the source identification of a received second learn-remote message if the central apparatus is in the learn-remote mode. Advantageously, further remote controls can only be programmed with the assistance of an already programmed remote control, functioning as a safe key.

A further embodiment according to the invention is characterised in that the central apparatus comprises timing means for taking the central apparatus out of the learn-remote mode after a predetermined period. By using a time-out, the period for learning an apparatus is restricted, reducing the chance of inadvertently storing the identification of a wrong apparatus.

A further embodiment according to the invention is characterised in that the user input means of the remote control is conceived to cause the transmission means to repeatedly transmit the learn-remote message in response to a prolonged duration of the learn trigger; and in that the reception means of the central apparatus is conceived to only process the first learn-remote message further after repeatedly receiving the first learn-remote message for a predetermined period. By requiring a prolonged user trigger for learning a remote control, the chance is reduced that a user inadvertently triggers the learning of a remote control.

A further embodiment according to the invention is characterised in that each message comprises a checksum; in that each transmission means is conceived to transmit a message a predetermined plural number of times, within a predetermined time frame; in that the reception means is conceived to verify whether a message has been received correctly and to only process a message further if the same message is at least twice received correctly within the predetermined time frame. In this way the chance of a wireless signal, for instance an RF signal generated by other systems such as wireless headphones, being inadvertently accepted as a valid message is reduced.

A further embodiment according to the invention is characterised in that the transmission means comprises timing means for, after a delay of at least two seconds, causing the transmission means to repeat transmitting the message the predetermined plural number of times, within the predetermined time frame. In this way the chance of a transmitted message not being accepted, for instance due to interference of another wireless signals, such as an RF signal, is reduced.

A further embodiment according to the invention is characterised in that the delay is chosen randomly within a predetermined time window. By using a random delay, the chance is reduced that apparatuses of the same system continuously interfere with each other.

A further embodiment according to the invention is characterised in that the central apparatus comprises a motion detector. To avoid that the system does not operate due to the transmission being interfered, for instance by a high power source generating a continuous RF signal, the central apparatus advantageously is combined with a motion detector. In this way, the central apparatus can function as a stand-alone security system, offering a guaranteed basic level of protection.

These and other aspects of the invention will be apparent from and elucidated with reference to the embodiments shown in the drawings.

DETAILED DESCRIPTION OF THE PREFERRED EMBODIMENTS

Figure 1:
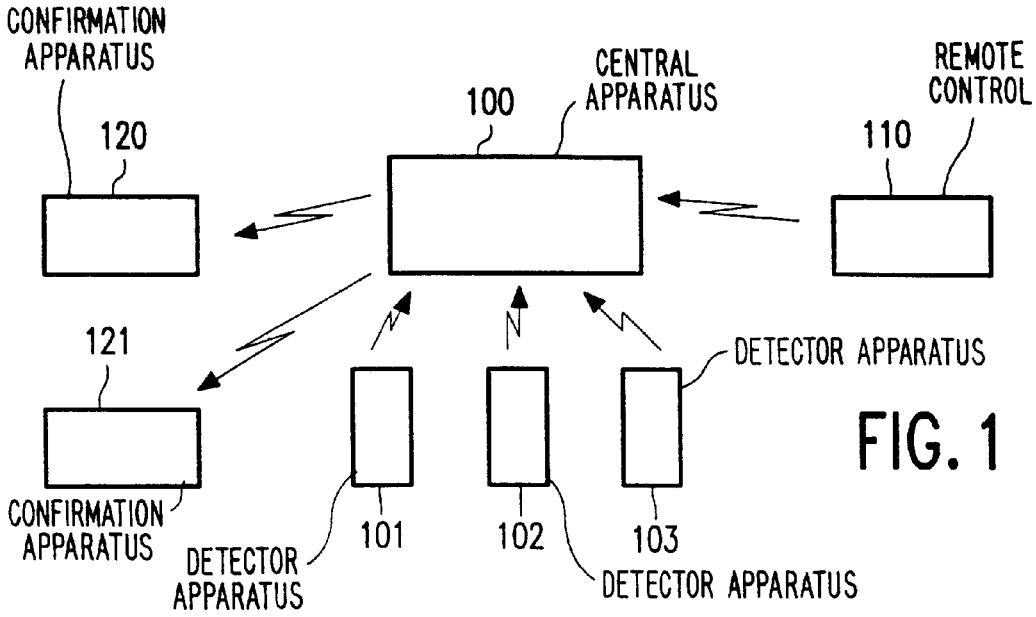
FIG. 1 shows a block diagram of an embodiment of a system according to the invention.

FIG. 1 shows the system according to the invention, comprising a central apparatus 100 and a plurality of detector apparatuses (101, 102, 103). The detector apparatuses may be intrusion/burglar detectors, such as motion detectors and door/windows detectors for detecting opening of a door/window. Other detector apparatuses may be used as well, such as technology sensors like a smoke/fire detectors, a carbon-monoxide detector, a water detector or a gas detector. The detector apparatus wirelessly transmits an alarm message to the central apparatus 100 upon detecting an alarm condition. Preferably, for the wireless transmissions, RF is used. Advantageously, a remote control 110 is used to operate the system. In this way the user may, for instance, arm or disarm the system. Since the range of the RF transmission is, typically, larger than the protected area, usually the user can arm and disarm the system from outside the protected area. This eliminates the need for the user having to leave the secure area within a short time after arming the system and having to disarm the system within a short period after entering the secure area. Due to the secure learning process, the remote control also functions as a secure key, eliminating the need to insert a physical key into the central apparatus to arm/disarm the system or use other secure methods, such as entering a PIN code. Advantageously, the remote control 110 transmits also via RF. In addition to allowing the user to control the system, the remote control 110 may also be used to transmit an alarm message to the central apparatus 100 on the initiative of the user of the system (a panic alarm).

The system may, further, comprise one or more confirmation apparatuses. FIG. 1 shows two confirmation apparatuses 120 and 121. The central apparatus 100 transmits status messages to the confirmation apparatuses. Based on these messages, the confirmation apparatuses indicate the status of the system using, for instance, LEDs, a display or sound signals.

Figure 2:
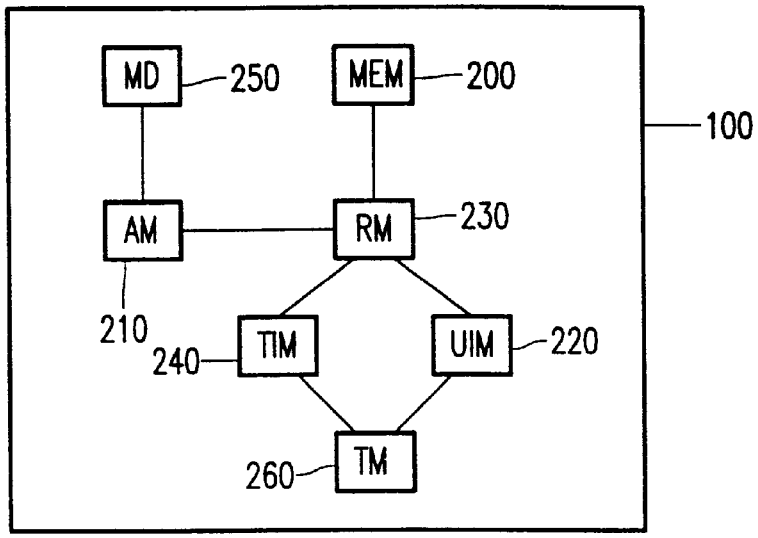
FIG. 2 shows a block diagram of an embodiment of a central apparatus according to the invention.

FIG. 2 shows a block diagram of the central apparatus 100. The central apparatus 100 comprises memory means 200. The memory means 200 comprises a plurality of memory locations for storing source identifications, such as network addresses. Preferably, the memory means 200 can store identifications of at least ten detector apparatuses and four remote controls. Advantageously, each memory location can be used for storing an identification of any type of detector apparatus or even other apparatuses supported by the system. Alternatively, some or all identifications may be reserved for a specific type of apparatus. For instance, at least one identification could be reserved for a remote control. The central apparatus 100 further comprises alarm means 210 for raising an alarm. The alarm means 210 may take various forms, such as a siren or a warning light used to scare off an intruder. Alternatively, a silent alarm may be raised, for instance by triggering a security company or the police. User interface means 220 of the central apparatus 100 are used to obtain input from a user. The user interface means 220 may take various forms, such as buttons or a key-operated switch. As will be described in more detail later on, also the remote control may be used for providing user input. The user interface means 220 can bring the central apparatus 100 in a selected mode, including an operational mode and a learning mode. Advantageously, the operational mode is divided further in an armed and a disarmed mode, allowing specific alarms to be raised depending on the sub-mode of the system and the detected alarm condition. As an example, detection of an intrusion causes an alarm to be raised only when the central apparatus is in the armed mode, and not in the disarmed mode. Detection of other types of alarm conditions, such as a smoke alarm, may result in the same alarm being raised in both sub-modes. The user interface means 220 may also be used to provide information to the user. To this end, for instance, LEDs or a display may be used to indicate the status of the system or prompt the user for input. Also audible feedback may be used, for instance, by using a beeper.

Figure 3:
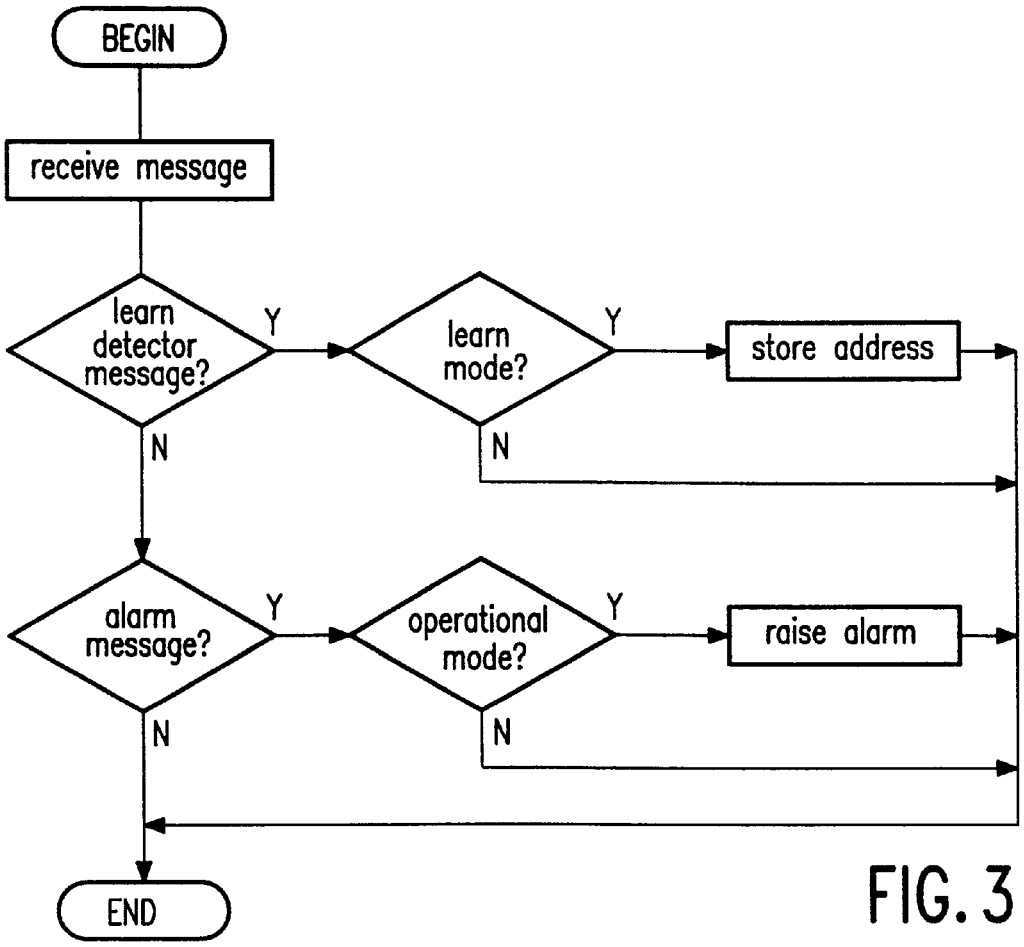
FIG. 3 illustrates a flow diagram in the central apparatus.

The central apparatus 100 further comprises reception means 230 for receiving a message which is transmitted via RF. The message comprises a source identification which uniquely identifies the transmitting apparatus. Distinct messages are used to provide different information to the central apparatus 100. As an example, a detector apparatus uses an alarm message to inform the central apparatus 100 of an alarm condition and a learn-detector message for triggering the central apparatus to add the transmitting detector apparatus to the list of apparatuses, which are part of the system. The reception means 230 stores the source identification of a received learn-detector message in the memory means 210 if the central apparatus 100 is in the learning mode. In response to receiving an alarm message, the reception means 230 causes the alarm means 210 to raise the alarm if the source identification of the received message is stored in the memory means 200. The alarm is only raised if the central apparatus 100 is in the operational mode. FIG. 3 shows a flow diagram of the handling in the central apparatus 100. As described earlier, sub-modes of the operational mode, such as an armed and disarmed mode, may influence the actual alarm being raised.

Advantageously, the central apparatus 100 also comprises timing means 240. Whenever the central apparatus is brought into a learning mode, the timing means 240 are triggered. After a predetermined period of, for instance, ten seconds, the timing means 240 ensures that the central apparatus is brought to another mode, such as the operational mode.

Preferably, the central apparatus 100 further comprises a motion detector 250, such as a passive infra-red detector. In this way, even if the communication between the detector apparatuses and the central apparatus 100 has been disrupted, the central apparatus 100 is still able to detect an intrusion and raise the alarm.

Figure 4:
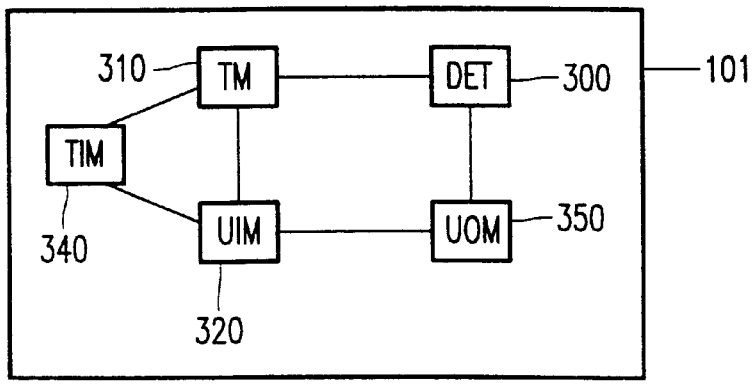
FIG. 4 shows a block diagram of an embodiment of a detector apparatus according to the invention.

FIG. 4 shows a block diagram of a detector apparatus. Only the block diagram of detector apparatus 101 is shown. The other detector apparatuses have the same or similar block diagram. The detector apparatus 101 comprises detection means 300 for detecting an alarm condition. Various forms of detector means for detecting a specific alarm condition external to the detector apparatus are well-known. Examples of detector means are a passive infra-red detector, a smoke detector, a fire detector, a water detector, a gas detector, a glass-break detector and a reed-magnetic contact for detecting opening of a door or window. Additionally, also alarm conditions effecting the operation of the detector apparatus itself may be detected, using for instance a tamper detector. The detector apparatus 101 further comprises transmission means 310 for transmitting a message via RF. Each detector apparatus has a communication identification, which is unique within the system. The identification is included in the message as a source identification uniquely identifying the transmitting apparatus. The detector apparatus 101 transmits a selected one of a number of distinct messages to provide information to the central apparatus 100. If the detection means 300 detects an alarm condition, the transmission means 310 transmits an alarm message to the central apparatus 100. The detector apparatus 101 also comprises user input means 320 for obtaining input from a user. The user input means 320 may take various forms, such as manually operatable buttons or a key-operated switch. In response to a learn trigger from the user, the user input means 320 causes the transmission means 310 to transmit a learn-detector message in order to trigger the central apparatus to add the transmitting detector apparatus to the list of apparatuses, which are part of the system.

Advantageously, the user input means 320 of the detector apparatus 101 is able to bring the detector apparatus 101 in a selected mode, including an operational mode and a learning mode. The detection means 300 only cause the transmission means 310 to transmit an alarm message, if the detector apparatus is in the operational mode. The user input means 320 only causes the transmission means 3 10 to transmit a learn-detector message if the detector apparatus is in the learning mode. Preferably, the operational mode is subdivided into an included and excluded mode. Whenever the user operates the user input means 320 to toggle between the included/excluded sub-mode, this sub-mode information is, beneficially, transmitted to the central apparatus 100. This allows the central apparatus 100 to indicate the information on a local display or to transmit a status message to a confirmation display, allowing the confirmation display to indicate that a detector apparatus has been included or excluded. Advantageously, excluding a detector apparatus is not allowed or results in raising an alarm if the central apparatus 100 is in the armed mode. Otherwise, an intruder might be able to exclude a detector apparatus before triggering the detector of the apparatus. Preferably, the detector apparatus 101 passes on detected alarm conditions to the central apparatus only when the detector apparatus 101 is in the included sub-mode. Advantageously, the detector apparatus 101 comprises timing means 340 to automatically include the detector apparatus 101 at a predetermined moment of, for instance, twelve hours after the detector apparatus 101 has been excluded. By selectively including or excluding detector apparatuses in or from the system, the user can use the system to only protect a selected area. As an alternative to the detector apparatus 101 operating mode and sub-mode dependent, the central apparatus 100 may provide the required intelligence. As an example, the central apparatus 100 can administrate the mode and sub-mode of the detector apparatus (and may even store this information in the memory means 200 in addition to the source identification of the detector apparatus) and operate mode or sub-mode dependent for each detector apparatus. In this way, the user input means 320 of the detector apparatus 101 relays all user inputs to the central apparatus, using special messages. As such, the detector apparatus 101 operates as a remote control, with respect to the user input. In such a configuration, the detector apparatus 101 unconditionally passes on detected alarm conditions to the central apparatus 100. The time-out for bringing a detector apparatus back to the included sub-mode would then be controlled by the timing means 240 in the central apparatus 100.

Preferably, the detector apparatus 101 comprises user output means 350 to provide information to the user. To this end, for instance, LEDs or a display may be used to indicate that an alarm has been detected or to indicate the mode and sub-mode of the detector apparatus 101. Also audible feedback may be used, for instance, by using a beeper or a buzzer.

Figure 5:
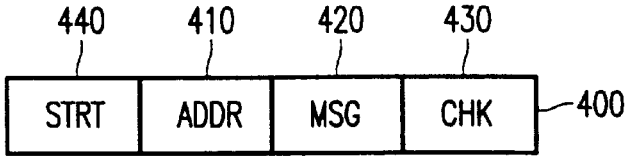
FIG. 5 illustrates frame structure for transmitting messages in the system.

FIG. 5 illustrates a possible frame structure 400 for transmitting messages via RF. The same frame structure may be used for all messages, transmitted by any type of apparatus, such as a detector apparatus, remote control, or the central apparatus 100. The frame structure 400 comprises an identification field 410 and a message field 420. The identification field 410 includes at least the identification of the transmitting apparatus, also referred as the source identification. In a simple system it is sufficient to only use a source identification, since only one type of apparatus is assigned to act upon a specific transmitted message. As an example, an alarm message transmitted by a detector apparatus or a user input message transmitted by a remote control is only acted upon by the central apparatus 100. A status message transmitted by the central apparatus 100 is only acted upon by confirmation apparatuses. In practice, the central apparatus 100 receives and acts upon all transmitted messages (with the exception of the messages transmitted by the central apparatus 100 itself). The confirmation apparatuses may act upon all messages transmitted by the central apparatus. In a more complex system, where for instance only a selected confirmation apparatus displays a certain status message or where more than one central apparatus is used, each covering part of the system, it may be beneficial to also include the identification of the intended receiving apparatus (destination identification) in the identification field 410. Advantageously, the identification is sufficiently large to reduce the chance of the same identification being used in neighbouring systems. Preferably, 24 bits are used for the identification, allowing a distinction between more than 16 million apparatuses. Advantageously, the identifications are grouped into a number of groups. A group may be used to identify an application area. Besides security, also other application areas, such as safety, lighting, heating/climate control and audio/video equipment may additionally be supported by the system and identified in such a manner. The central apparatus 100 can, based on the received source identification, determine to which application area the message corresponds and deal with it accordingly. Specialised sub-units or modules within the central apparatus 100 may be used to adequately deal with the various areas. As an alternative or in addition to this grouping, a group may also be used to identify a specific type of apparatus within an application area. As an example, within the application area security, a first distinction may be made between a detector apparatus, a remote control and a confirmation apparatus. For the detector apparatuses a further distinction may be made between a magnetic contact, an infra-red detector, a PIR ceiling alarm, a PIR wall alarm, a vibration alarm, a flashlight and a siren. Based on the type information, the central apparatus 100 may, for instance, raise a type specific alarm, such as causing fire doors to be closed if an alarm message is received from a fire detector. If both levels of grouping are used (area and type within an area), as an example, four bits may be used to indicate the area and four bits to indicate the type within the area, leaving 16 bits to identify the specific apparatus within the given area and type. An example of part of such an identification system is shown in the following table. The table shows eight bits (area code and type code) of the source identification.

| Area code | Area description | Type code | Type description |
|---|---|---|---|
| '0'H | Central apparatus | '0'H | — |
| '1'H | Security equipment | '0'H | magnetic contact |
| | | '1'H | infra-red detector |
| | | '2'H | PIR ceiling |
| | | '3'H | PIR wall |
| | | '4'H | Vibration alarm |
| | | '5'H | Flashlight |
| | | '6'H | Siren |
| | | '7'H | Remote control |
| | | '8'H | Confirmation display |
| '2'H | safety equipment | | |
| '3'H | Lighting | | |
| '4'H | Heating/climate | | |
| '5'H | Audio/Video | | |

It will be appreciated that other groupings may be used as well. Furthermore, an optimum number of bits for the area and type may be used as required for certain products. As an example, it may be sufficient to reserve only one area and type code '00'H for the central apparatus, allowing the remaining code '01'H to '0F'H to be used for other apparatuses.

Figure 6:
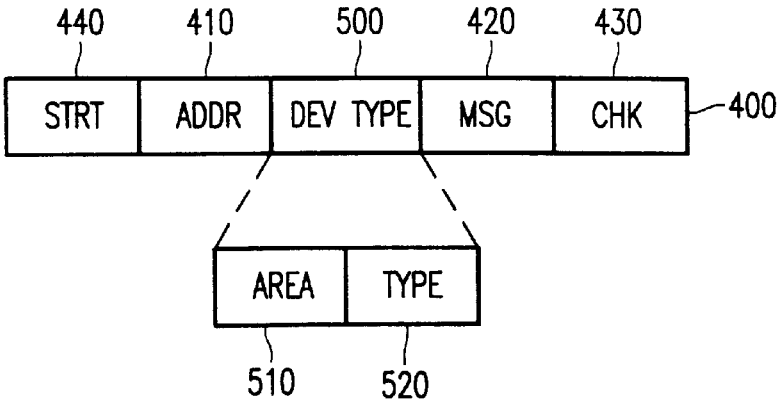
FIG. 6 illustrates a further frame structure for transmitting messages in the system.

As an alternative to incorporating type information in the identification field, a separate device type field 500 may be used, as shown in FIG. 6. If required the device type field 500 can be further divided into a area field 510 and a type field 520. If for each of both sub-fields four bits are used, the same coding as shown in the preceding table for the area and type can be used for the device type field 500.

Instead of always transmitting the type information in a fixed field of the frame or incorporating the type information into the identification scheme, the type information may only be incorporated in the learning messages. In this case, the central apparatus 100, which receives the learning message and stores the source identification of the received message, additionally stores the type information. The central apparatus uses the type information when it receives an alarm message. In this approach, the alarm message can be coded in a compact manner and does not need to include any type information, resulting in a shorter duration of the transmission. Consequently, the reliability of the transmission is increased and the chance of the transmission being terminated by an intruder is reduced.

The frame structure, shown in FIGS. 5 and 6, also includes a message field 420. The message field 420 may, for instance, be one or two bytes long. Various different messages can be transmitted by the system. As an example, a distinction is made between an alarm message and a learn-detector message. For the alarm message a further distinction can be made between an external alarm condition and an internal alarm condition, such as detection of low-power or tampering. As an alternative to using the source identification to identify a specific area or a type of product, the coding of the messages may provide the same information. As an example, the following table shows part of such a message coding system, using two-byte messages. The first byte comprises the area and type code; the second byte comprises the message code. In the table, the messages are specified for the transmitting apparatus.

| Area and type code | Area and type description | Message code | Message description |
|---|---|---|---|
| '00'H | Central apparatus | '00'H | Learn central apparatus |
| | | '01'H | Status-armed mode |
| | | '02'H | Status-disarmed mode |
| | | '03'H | Status-Learning mode |
| | | '04'H | Status-Learn-remote mode |
| | | '05'H | Status-Info mode |
| | | '06'H | Status-External alarm |
| | | '07'H | Status-tamper alarm |
| | | '08'H | Status-Low power |
| | | '09'H | Status-Detector included |
| | | '0A'H | Status-Detector excluded |
| '10'H | Magnetic contact | '00'H | Learn detector |
| | | '06'H | External alarm detected |
| | | '07'H | Tamper alarm detected |
| | | '08'H | Low power detected |
| | | '09'H | Include detector |
| | | '0A'H | Exclude detector |
| '11'H | Infra-red detector | '00'H | Learn detector |
| | | '06'H | External alarm detected |
| | | '07'H | Tamper alarm detected |
| | | '08'H | Low power detected |
| | | '09'H | Include detector |
| | | '0A'H | Exclude detector |
| '17'H | Remote control | '00'H | Learn remote |
| | | '01'H | Arm system |
| | | '02'H | Disarm system |
| | | '04'H | Go to learn remote mode |
| | | '05'H | Go to info mode |
| | | '06'H | Panic trigger |

It will be appreciated that a number of, possibly different type of, detector means may be combined in one detector apparatus. With respect to the central apparatus 100, each detector means may act like a separate detector apparatus, with a separate communication identification and separately being trained. By using type information in the alarm messages, advantageously, a combined detector apparatus only needs to have one identification and only needs to be trained once, where the type information allows the central apparatus 100 to raise a type specific alarm.

To improve the reliability of the system, the frame structure 400, advantageously, includes a checksum field 430, as shown in FIGS. 5 and 6. The checksum may, for instance, be one byte long. Various forms of checksums, such as parity or cyclic redundancy checks are known. For a simple system with relatively short messages, using the sum over all bits of the frame as the checksum provides a good level of detecting a corruption during the transmission.

Figure 7:
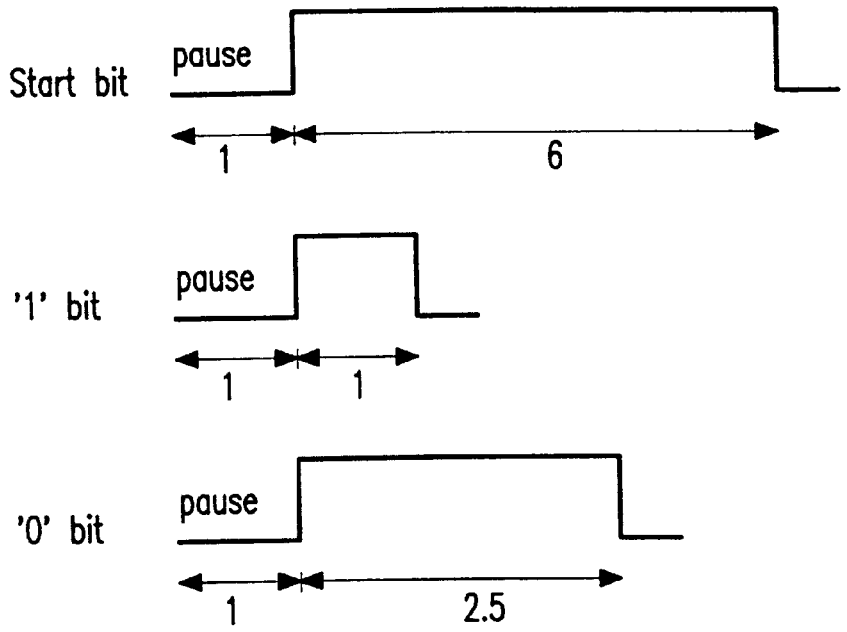
FIG. 7 shows a pulse width modulation for modulating the messages.

Various encoding and modulation techniques, such as Frequency Shift Keying (FSK) and Phase Shift Keying (PSK) are generally known for transmitting digital messages using Radio Frequencies (RF). For a simple system, it is advantageous to use a Pulse Width Modulation (PWM) technique. As an example, each bit of the frame is encoded in two periods. During the first period, the pause period, no signal is transmitted. During the second period an RF signal of, for instance 433.92 MHz., is transmitted. The duration of the second period (the width) corresponds to the data bit being transmitted. An example is shown in FIG. 7, where the first period has a fixed duration of one millisecond. The second period has a duration of 1 millisecond for transmitting a logical '1' and 2.5 milliseconds for transmitting a logical '0'. In order to allow a receiver to determine the start of a frame, the frame structure 400, advantageously, includes a start field 440, as shown in FIGS. 5 and 6. The duration of the second period of the start bit differs from the duration used for the logical '0' and '1'. To clearly distinguish the startbit, the second period of the start bit may have a duration of 6 milliseconds.

Figure 8:
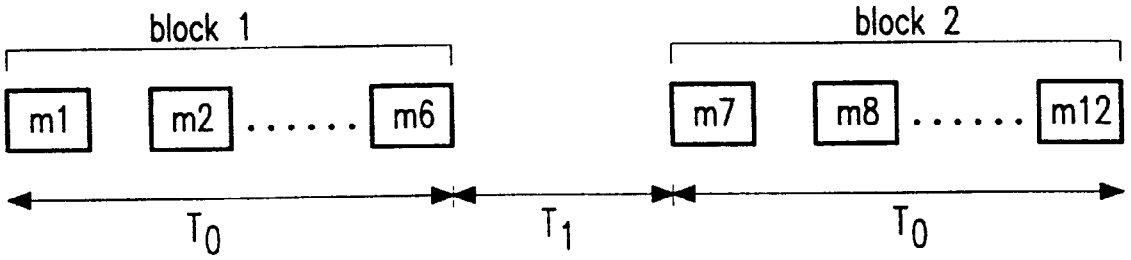
FIG. 8 illustrates a transmission scheme for transmitting the messages.

The receiving means 230 of the central apparatus 100 may use the timing information (duration of pause, and second period for a '0'-, '1'-, and start-bit) to determine whether a message has been received correctly, in addition to using the information derived from the checksum. A message, which has not been received correctly, is discarded by the message receiving means 230. To reduce the chance of a message not being received correctly, the transmitting means 310 of the detector apparatus 101 retransmits the same message a number of times. Preferably, the same message is transmitted six times in succession, as illustrated in FIG. 8. In this way normal, short disturbances of the RF signal can be recovered. In certain situations the signal may be disturbed for a longer period, for instance caused by other products, such as wireless headphones, operating at a similar frequency or by another apparatus of the same security system transmitting at a similar moment. To overcome such disturbances, the message is retransmitted again after a predetermined delay time T1. Similarly as before, it is beneficial to retransmit the message a number of times. FIG. 8 shows that the message is retransmitted six times after the delay time T1. It will be appreciated that the process of a block of quick retransmissions followed by a delay and a retransmission of the block can be repeated for as long as desired. Particularly for an alarm message, a detector apparatus may repeat this process for as long as an alarm condition exists. In the repetition, T1 is chosen sufficiently long to ensure that most disturbances have ended. Preferably, T1 is chosen longer than two seconds. A delay time of four seconds for T1 provides a good balance between a long delay time in order to overcome temporary disturbances and a short delay time in order to achieve a good response time of the system. Advantageously, T1 is chosen randomly within a predetermined time window of, for instance, two to six seconds. This reduces the chance that the transmission processes of a number of apparatuses of the same system, which started transmitting at a similar moment (for instance triggered by a same event), stay synchronised, causing no message to be received correctly.

Without special precautions the receiving means 230 of the central apparatus 100 may receive a signal transmitted by other products transmitting at a similar RF frequency. In order to reduce the chance that such a signal mistakenly is interpreted as a valid message (and, therefore, could result in an alarm being raised) in addition to checking the timing of the signal and the checksum of the message, the previously described transmission scheme may be used to further improve the reliability of the system. Advantageously, the receiving means 230 only processes a received message further if the same message is received a number of times in the same block of messages. As an example, if the block consists of six transmission of the same message, the receiving means 230 only processes the message after twice receiving the same message. If a higher level of reliability is required, the threshold for starting processing of the message may be higher, even up to the number of transmissions in the block (in the example, six). The total duration of the block of quick retransmissions is limited by a predetermined time frame $T_0$. As an example, the duration of the block may be defined as ranging from the beginning of the first message in the block to the end of the last message in the block, as indicated in FIG. 8. In general $T_0$ will be longer than the actual time ($T_x$) required to transmit the messages in the block. Preferably, To is sufficiently larger than $T_x$, allowing transmissions of other apparatuses to take place in the remaining time ($T_0$–$T_x$). Instead of distributing the remaining time equally between the transmissions within a block, it is beneficial to distribute the remaining time randomly between the transmissions within a block, reducing the chance of transmissions of different apparatuses staying synchronised and repeatedly causing each message to be disrupted. The timing means 340 of the detector apparatus 101, as shown in FIG. 4, can be used to control the random or equal distribution of the remaining time. The timing means 240 of the central apparatus 101, as shown in FIG. 2, is used to determine whether messages, which are successively and correctly received, originate from the same block of transmissions. Using the above given definition of $T_0$, the timing means 240 may be started at the beginning of the first message which is received correctly. By ensuring that $T_1$ is longer than $T_0$, the timer may be set to expire after $T_0$. In this way it is safe to assume that any message received while the timer is active originates from the same block. In systems with many short disturbances of the signal, it is beneficial to set the timer to a larger time, also including at least one more block of transmissions. As an example, the timer may be set to twice $T_0$ plus $T_1$.

It will be appreciated that in addition to the described measures for increasing the reliability of the communication, the receiving means 230 may additionally use thresholds for determining whether the received signal is transmitted by one of the apparatuses of the system or that a potential intruder or another source generates a signal to block transmissions of an alarm message. As an example, if for a prolonged period no pause signal is detected this may be interpreted as a blocking signal being transmitted and result in an alarm being raised.

Figure 9:
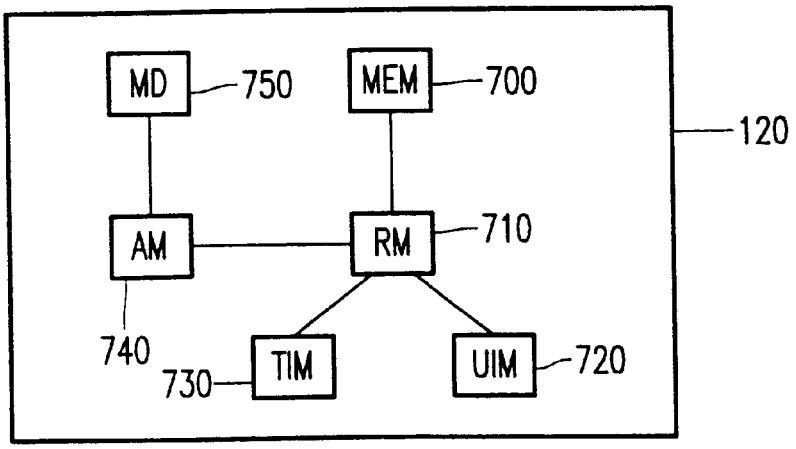
FIG. 9 shows a block diagram of an embodiment of a confirmation apparatus according to the invention.

FIG. 9 shows a block diagram of a confirmation apparatus. Only the block diagram of confirmation apparatus 120 is shown. The other confirmation apparatuses have the same or similar block diagram. The confirmation apparatus 120 comprises memory means 700. The memory means 700 comprises a memory location for storing a source identification. Typically, the memory means 200 comprises only one memory location, which is reserved for storing the identification of the central apparatus 100. In a system with a modular approach for the central apparatus or where the other apparatuses may directly transmit messages to the confirmation display, more than one memory location for storing identifications is required. As described earlier, the central apparatus 100 transmits status messages to the confirmation apparatuses. To this end, the central apparatus 100 comprises transmission means 260, as shown in FIG. 2. Preferably, the transmission means 260 operates in the same way as the transmission means 310 of the detector apparatuses. The confirmation apparatus 120 comprises reception means 710 for receiving a message which is transmitted via RF. Preferably, also the reception means 710 of the confirmation apparatus 120 operates in the same way as the reception means 230 of the central apparatus 100. The confirmation apparatus 120 further comprises user interface means 720. The user interface means 720 comprises means for providing information, including the status of the system, to the user, for instance by using LEDs or a display. The user interface means 720 also comprises means for obtaining input from the user, for instance by using manually operatable buttons. As described earlier, the transmitted messages comprise a source identification which uniquely identifies the transmitting apparatus. Distinct messages are used to provide different status information to the confirmation apparatus 120. To ensure that the confirmation apparatus 120 only displays status information relating to its own system and not to a neighbouring system, the identification of a received status message is checked. The reception means 710 of the confirmation apparatus 120 only causes the user interface means 720 to display the status of a received status message if the source identification of the received message matches the identification stored in the memory means 700. A learning process is used to ensure that, with a reasonable reliability, the stored identification is the identification of the central apparatus 100 of the system to which the confirmation apparatus 120 belongs. To this end, the transmission means 260 of the central apparatus 100 transmits a special learn-central-apparatus message, which is distinct from any other message used in the system. The message is only transmitted in response to a special user trigger received by the user input means 220 of the central apparatus. Optionally, the user interface means 220 only triggers the transmission if the user has brought the central apparatus 100 in the learning mode, or even in a special learn-confirmation-apparatus mode. To increase the reliability even further, the source identification of a received learn-central-apparatus message is only stored in the memory means 700 of the confirmation apparatus 120 if the user, via the user interface means 720, has brought the confirmation apparatus 120 from a normal operational mode into a special learning mode.

Advantageously, the confirmation apparatus 120 also comprises timing means 730. Whenever the confirmation apparatus 120 is brought into the learning mode, the timing means 730 are triggered. After a predetermined period of, for instance, ten seconds, the timing means 730 ensures that the confirmation apparatus 120 is brought to another mode, such as the operational mode.

The confirmation apparatus 120 may further comprise alarm means 740 for raising an alarm in response to receiving a status message indicating an alarm condition. The alarm means 740 may take various forms, such as a siren or a warning light, scaring off the intruder. Advantageously, a buzzer or beeper is used, making it possible to use the confirmation apparatus 120 as a portable 'silent' alarm, which the user may carry around or, for instance, place in the bedroom. If the confirmation apparatus 120 is placed in a fixed location, the confirmation apparatus 120, preferably, further comprises a motion detector 750, such as a passive infra-red detector. Since a confirmation apparatus is typically located near an entrance, allowing a user to quickly check the status of the system, the entrance is guarded in this way by a confirmation apparatus which detects and locally raises an alarm. This provides a basic level of protection, even if the communication between the detector apparatuses and the central apparatus 100 has been disrupted.

It will be appreciated that, in principle, an unlimited number of confirmation apparatuses can be used in the system. Since in the basic form no destination identification is used for transmitting a status message to a specific confirmation apparatus, the status message is received by all confirmation apparatuses in the system which have been trained with the identification of the central apparatus 100.

Figure 10:
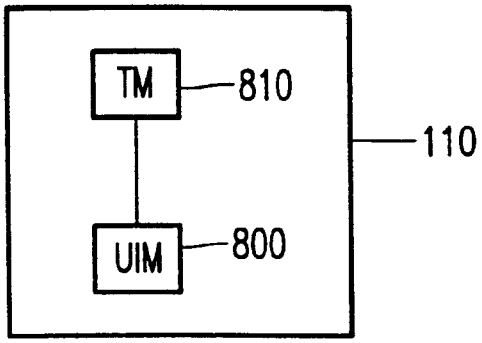
FIG. 10 shows a block diagram of an embodiment of a remote control according to the invention.

FIG. 10 shows a block diagram of the remote control 110. The system may comprise more remote controls with the same or a similar block diagram. The remote control 110 comprises user input means 800 for obtaining input from a user. Typically, the input is provided using manually operatable buttons. The remote control 110 further comprises transmission means 810 for transmitting a message via RF. Preferably, the transmission means 810 operates in the same way as the transmission means 310 of the detector apparatuses, allowing the central apparatus 100 to receive a message transmitted by the remote control using the same receiving means 230. In response to a user trigger, a trigger-specific user-input message is transmitted, allowing the central apparatus to act on the user input. Like the other apparatuses, the remote control has a communication identification, which is unique within the system. The identification is included in the message as a source identification uniquely identifying the transmitting apparatus. To ensure that the system can only be controlled using authorised remote controls, the source identification is used as an access check. Typically, the memory means 200 of the central apparatus 100 comprises initially no source identification of a remote control. In order to program a first remote control, the user needs to trigger the learn operation in the remote control. Preferably measures are taken to avoid that the learn operation is triggered inadvertently, for instance by requiring the user to press two buttons simultaneously or to press a button for a prolonged period of time before the learn operation is activated. In response to a learn trigger the user input means 800 causes a learn-remote message to be transmitted. If no remote control has been programmed yet (i.e. the memory means 200 comprises no identification of a remote control), the reception means 230 stores the source identification of the received learn-remote message in the memory means 200. Various methods can be used to detect whether a remote control has been programmed yet. In a simple system, it may be required that a remote control is always programmed first. In such a system, as soon as at least one identification has been trained into the memory means 200 it is assumed that this is an identification of a remote control. Preferably, the reception means 230 checks, in such a system, that the first identification stored indeed is derived from a learn-remote message. In an alternative approach, one or more memory locations are reserved for remote controls. As another option, the type of the apparatus is stored in addition to the identification. The type may be determined as described earlier.

Once a remote control has been trained, this remote control is considered safe. If the reception means 230 receives a normal user-input message from a remote control, it checks whether the source identification of the message is stored in the memory means 200. If so, the message is relayed to the user interface means 220 for further processing as if the input was entered locally at the central apparatus 100. If not, the message is discarded and, optionally, an alarm signal is given. For training subsequent remote controls, the first remote control is used to bring the central apparatus 100 in a learn-remote mode. Preferably, this is achieved by using the same learn-remote message as used to train the first remote control. The reception means 230 of the central apparatus 100 checks whether the source identification of the received learn-remote message is already stored in the memory means 200. If this is the case, the reception means 230 brings the central apparatus 100 in the learn-remote mode. This mode may be the same as the learn mode used for training detector apparatuses. Next, the user needs to trigger the learn operation in the second remote control. Advantageously, the same trigger is used as for training the first remote control. In response to this trigger the user input means 800 causes a learn-remote message to be transmitted. The reception means 230 stores the source identification of the received learn-remote message in the memory means 200, if the central apparatus is in the learn-remote mode. Preferably, the timing means 240 of the central apparatus 100 are used to take the central apparatus 100 out of the learn-remote mode after a predetermined period of, for instance, ten seconds.

Since an already trained remote control acts as a safe key and improves the reliability of the system with respect to training new remote controls, preferably the system is supplied to the customer with the included remote controls already being programmed.

Advantageously, the transmission means 810 of the remote control transmits a message a number of times in a quick repetition, forming a block as shown in FIG. 8. If the user provides the same user input trigger for a prolonged period of time, preferably, the user input means 800 causes this process to be repeated, resulting in the transmission of a second block, or even more blocks in the case of a very long trigger. Preferably, the reception means 230 of the central apparatus 100 only processes a learn-remote message when the reception means 230 has repeatedly received the learn-remote message for a predetermined period. For instance, the reception means 230 only processes the message if it has received the same message in at least two successive blocks (a total duration as $2*T_0+T_0$). By using this mechanism for the learn-remote message, the chances of a remote control being stored in response to a user inadvertently triggering the learning operation are reduced even further.

It will be appreciated, that in certain circumstances the user may need to be able to remove an apparatus from the memory means 200 of the central apparatus 100. This may for instance be required if the user loses a remote control or an apparatus has become faulty. The system may offer the user the possibility to selectively remove apparatuses. As an example, the system could indicate during the training process in which memory location the apparatus is stored. The user can use this information for removing an apparatus. Alternatively, the system may offer the user the possibility to reset the memory means, removing all identifications. Particularly in the last situation, preferably, barriers are provided to ensure that a trigger for resetting the memory is not given inadvertently. As an example, it may be required that such a trigger can only be entered directly at the central apparatus 100 by using a physical key or pressing a button, which cannot easily be accessed.

Figure 11:
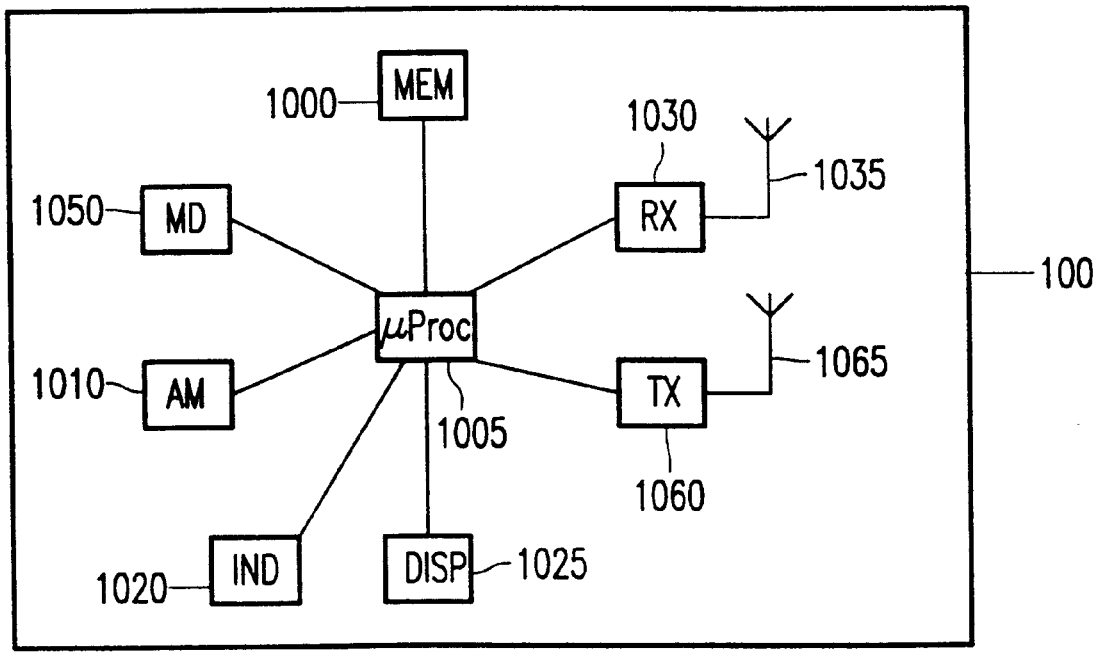
FIG. 11 illustrates a block diagram of a microprocessor-based implementation of the central apparatus.

Typically, the apparatuses of the system are implemented using a microprocessor. FIG. 11 shows a block diagram of a microprocessor-based implementation of the central apparatus 100. A microprocessor 1005, such as the PIC16C58A of Microchip Technology Inc., is used to process input from input means 1020, such as a buttons, and to provide output to output means 1025, such as an LCD display or LEDs. The program for the microprocessor 1005 may be stored in an external program memory, such as a ROM, or may be embedded in the microprocessor 1005. Similarly, variable data required for executing the program, such as the mode of the central apparatus 100, may be stored in a memory, such as an external RAM or internal registers. Via an aerial 1035 an RF signal is received and demodulated using a receiver 1030, such as model NB-1M of Aurel S.p.a., resulting in a digital signal being processed by the microprocessor 1005. The processor transmits messages by providing a digital signal to a transmitter 1060, such as model TX-433-SAW of Aurel S.p.a., which modulates the signal and transmits it via aerial 1065. The microprocessor 1005 stores identifications of trained apparatuses in the memory 1000, such as an EEPROM. The microprocessor 1005 further processes input from the motion detector 1050. In case of an alarm condition detected either using the motion detector 1050 or received by the receiver 1030, the microprocessor 1005 activates an alarm 1010, such as a siren. It will be appreciated that the microprocessor may be programmed to control apparatuses in other application areas, such as lighting and consumer electronics, as well. The same identification learning mechanisms can be used to ensure that only the desired apparatuses are controlled.

We claim:

1. A security system, comprising a central apparatus and at least one detector apparatus; the detector apparatus comprising transmission means for wirelessly transmitting a message comprising a source identification uniquely identifying the transmitting apparatus, and detection means for detecting an alarm condition and in response causing the transmission means to transmit a message;

the central apparatus comprising:

memory means for storing a source identification of at least one detector apparatus;

alarm means for raising an alarm;

user interface means for bringing the central apparatus in a selected one of a plurality of modes, including an operational mode and a learning mode; and reception means for receiving a wirelessly transmitted message, for storing, in the learning mode, the source identification of a received message in the memory means, and for causing, in the operational mode, the alarm means to raise an alarm if the source identification of a received message is stored in the memory means, characterised in that the detection means is adapted to cause the transmission means to transmit an alarm message in response to detecting an alarm condition;

in that the detector apparatus comprises means for causing the transmission means to transmit a learn-detector message in response to a learn trigger; said learn-detector message being distinct from said alarm message;

in that the reception means is adapted to cause the alarm to be raised in response to receiving an alarm message, and to store the source identification only of a received learn-detector message.

2. A security system as claimed in claim 1, characterized in that a user input means of the detector apparatus is conceived to bring the detector apparatus in a selected one of a plurality of modes, including an operational mode and a learning mode;

in that the detection means is conceived to only cause the transmission means to transmit the alarm message if the detector apparatus is in the operational mode; and in that the user input means of the detector apparatus is conceived to only cause the transmission means to transmit the learn-detector message if the detector apparatus is in the learning mode.

3. A security system as claimed in claim 1, wherein the system comprises a plurality of different types of detector apparatuses; each type of detector apparatus detecting a different type of alarm condition external to the detector apparatus, characterised in that the learn-detector message comprises type information identifying the type of detector apparatus; and in that the alarm means is conceived to raise a type-specific alarm.

4. A security system as claimed in claim 3, characterised in that the source identification corresponds to one of a plurality of groups of source identifications; each group corresponding to one of the different types of detector apparatuses and in that the alarm means derives the type information from the source identification of a received alarm message.

5. A security system as claimed in claim 3, characterised in that the alarm and learn-detector message comprise a first field comprising the source identification and a second field comprising the type information; and in that the reception means is conceived to also store, in the learning mode, the type information of a received learn-detector message.

6. A security system as claimed in claim 1, wherein the system comprises a plurality of different types of detector apparatuses; each type of detector apparatus detecting a different type of alarm condition external to the detector apparatus, characterised in that the detection means is conceived to cause the transmission means to select and transmit a type-specific alarm message; and in that the alarm means is conceived to raise a type-specific alarm.

7. A security system as claimed in claim 1, characterised in that the detector apparatus comprises a plurality of different types of detection means for detecting different types of alarms conditions external to the detector apparatus; in that the detection means is conceived to cause the transmission means to select and transmit a type-specific alarm message in response to detecting an alarm condition; and in that the alarm means is conceived to raise a type-specific alarm.

8. A security system as claimed in characterised in that the system comprises a confirmation apparatus;

in that the central apparatus comprises transmission means for selecting one of a plurality of distinct messages, said plurality including a status message indicating a status of the system and a learn-central-apparatus message; the message comprising a source identification uniquely identifying the central apparatus; and for wirelessly transmitting the selected message;

in that the user interface means of the central apparatus is conceived to cause the transmission means to select and transmit the learn-central-apparatus message in response to a user trigger;

in that the confirmation apparatus comprises user interface means for bringing the confirmation apparatus in a selected one of a plurality of modes, including an operational mode and a learning mode in response to user input;

in that the confirmation apparatus comprises reception means for receiving a wirelessly transmitted message, for storing the source identification of a received learn-central-apparatus message in a memory only if the confirmation apparatus is in the learning mode, and for causing the user interface means to indicate the status of the system in response to receiving a status message whose source identification is stored in the memory.

9. A security system as claimed in claim 8, characterised in that the user interface means of the central apparatus is conceived to only cause the transmission means to select and transmit the learn-central-apparatus message if the central apparatus is in the learning mode.

10. A security system as claimed in claim 1, wherein the system comprises a remote control; the remote control comprising transmission means for wirelessly transmitting a message comprising a source identification uniquely identifying the transmitting remote control, and user input means for causing the transmission means to transmit in response to a user trigger a trigger-specific user-input message to the central apparatus, characterised:

in that the memory means comprises a plurality of memory locations for storing source identifications of remote controls;

in that the user interface means of the central apparatus is conceived to, in response to a user trigger, remove all source identifications of remote controls from the memory;

in that the user input means of the remote control is conceived to cause the transmission means to transmit a learn-remote message in response to a learn trigger from a user;

in that the reception means of the central apparatus is conceived to store the source identification of a received learn-remote message if the memory comprises no source identification of a remote control yet; and in that the reception means of the central apparatus is conceived to relay a received user-input message to the user interface means for further processing if the source identification of the message is stored in the memory.

11. A security system as claimed in claim 10, characterised in that the reception means of the central apparatus is conceived to bring the central apparatus into a learn-remote mode in response to receiving a first learn-remote message if the source identification of the first learn-remote message is stored in the memory, and in that the reception means of the central apparatus is conceived to store the source identification of a received second learn-remote message if the central apparatus is in the learn-remote mode.

12. A security system as claimed in claim 11, characterised in that the central apparatus comprises timing means for taking the central apparatus out of the learn-remote mode after a predetermined period.

13. A security system as claimed in claim 10, characterised in that the user input means of the remote control is conceived to cause the transmission means to repeatedly transmit the learn-remote message in response to a prolonged duration of the learn trigger; and in that the reception means of the central apparatus is conceived to only process the first learn-remote message further after repeatedly receiving the first learn-remote message for a predetermined period.

14. A security system as claimed in claim 1, characterised in that each message comprises a checksum; in that each transmission means is conceived to transmit a message a predetermined plural number of times, within a predetermined time frame; in that the reception means is conceived to verify whether a message has been received correctly and to only process a message further if the same message is at least twice received correctly within the predetermined time frame.

15. A security system as claimed in claim 14, characterised in that the transmission means comprises timing means for, after a delay of at least two seconds, causing the transmission means to repeat transmitting the message the predetermined plural number of times, within the predetermined time frame.

16. A security system as claimed in claim 15, characterised in that the delay is chosen randomly within a predetermined time window.

17. A security system as claimed in any one of the preceding claims, characterised in that the central apparatus comprises a motion detector.

* * * * *